US011566617B2

(12) United States Patent
Blechschmidt

(10) Patent No.: US 11,566,617 B2
(45) Date of Patent: Jan. 31, 2023

(54) TOOTHING SYSTEM FOR A GEROTOR PUMP, AND METHOD FOR GEOMETRIC DETERMINATION THEREOF

(71) Applicant: NIDEC GPM GmbH, Auengrund ot Merbelsrod (DE)

(72) Inventor: Andreas Blechschmidt, Zella-Mehlis (DE)

(73) Assignee: NIDEC GPM GmbH, Auengrund ot Merbelsrod (DE)

( * ) Notice: Subject to any disclaimer, the term of this patent is extended or adjusted under 35 U.S.C. 154(b) by 181 days.

(21) Appl. No.: 16/969,840

(22) PCT Filed: Nov. 22, 2018

(86) PCT No.: PCT/EP2018/082234
§ 371 (c)(1),
(2) Date: Aug. 13, 2020

(87) PCT Pub. No.: WO2019/161951
PCT Pub. Date: Aug. 29, 2019

(65) Prior Publication Data

US 2020/0392956 A1 Dec. 17, 2020

(30) Foreign Application Priority Data

Feb. 20, 2018 (DE) ..... 102018103723.6

(51) Int. Cl.
*F04C 2/08* (2006.01)
*F04C 2/10* (2006.01)
*F01C 1/08* (2006.01)

(52) U.S. Cl.
CPC ..... *F04C 2/084* (2013.01); *F01C 1/084* (2013.01); *F04C 2/102* (2013.01)

(58) Field of Classification Search
CPC ..... F04C 2/084; F04C 2/102; F01C 1/084
See application file for complete search history.

(56) References Cited

U.S. PATENT DOCUMENTS 9,097,250 B2 * 8/2015 Fujiki ..... F04C 2/102
2012/0177525 A1 7/2012 Uozumi et al.
(Continued)

FOREIGN PATENT DOCUMENTS

AT 184824 B 2/1956
CN 1532403 A 9/2004
(Continued)

OTHER PUBLICATIONS

DERWENT English Abstract of of JP2011-017318A (Year: 2011).*
(Continued)

*Primary Examiner* — Dominick L Plakkoottam
*Assistant Examiner* — Paul W Thiede
(74) *Attorney, Agent, or Firm* — Honigman LLP

(57) ABSTRACT

A toothing for a gerotor pump comprises a plurality of outer teeth (10) at a gerotor inner element (1) and a plurality of inner teeth (20) greater by one at a gerotor outer element (2), wherein a centre (M1) of the gerotor inner element (1) is offset from a centre (M2) of the gerotor outer element (2) by an eccentricity (e), the outer teeth (10) thereby meshing with the inner teeth (20). A contour of the outer teeth (10) at the gerotor inner element (1) is essentially defined by a curve of a single ellipse from a tooth tip (11) continuously via tooth flanks (13) to a transition radius (14) towards a tooth space or a tooth root (12); wherein the principal axis of the ellipse is arranged radially to the gerotor inner element (1) and the centre of the ellipse determines a radius ($R_{min}$) at the gerotor inner element (1) which corresponds to the maximum meshing depth of the gerotor outer element (2) between the outer teeth (10) at the meshing.

18 Claims, 5 Drawing Sheets

(56) References Cited

U.S. PATENT DOCUMENTS

| | | | | |
|---|---|---|---|---|
| 2013/0115124 | A1 | 5/2013 | Fujiki et al. | |
| 2016/0090983 | A1* | 3/2016 | Miyajima | F04C 2/102 418/16 |

FOREIGN PATENT DOCUMENTS

| | | | |
|---|---|---|---|
| CN | 102510952 | A | 6/2012 |
| DE | 69607927 | T2 | 10/2000 |
| DE | 10208408 | A1 | 9/2003 |
| EP | 0779432 | A1 | 6/1997 |
| EP | 2592271 | A2 | 5/2013 |
| EP | 2669521 | A1 | 12/2013 |
| GB | 439908 | A | 12/1935 |
| JP | 2011017318 | A | 1/2011 |

OTHER PUBLICATIONS

International Preliminary Report on Patentability dated Jan. 9, 2020 (translation provided Aug. 20, 2020) relating to International Application No. PCT/EP2018-082234).

Office Action dated Aug. 3, 2021, by the Chinese Patent Office relating to Application No. 201880089115.9.

Office Action dated Feb. 22, 2019, by the German Patent Office relating to Application No. 102018103723.6.

The Latest Trends in Oil Pump Rotors for Automobiles, S. Arinaga, et al., SEI Technical Review, No. 82, Apr. 2016, pp. 59-65.

International Search Report (with Translation) and Written Opinion dated Feb. 18, 2019, relating to International Application No. PCT/EP2018/082234.

* cited by examiner

TOOTHING SYSTEM FOR A GEROTOR PUMP, AND METHOD FOR GEOMETRIC DETERMINATION THEREOF

The invention relates to a toothing for a low-wear and volumetrically efficient gerotor pump and to a method which permits geometric determination to develop such toothings.

In the prior art, different tooth geometries have already been developed for rotor elements of a gerotor for use in pumps. Gerotor pumps belong to a type of rotary displacement pumps which are used preferably to convey viscous media such as oils and, compared to oscillating displacement pumps, have a lower pulsation in terms of the initial pressure.

In a specialist article entitled "The Latest Trends in Oil Pump Rotors for Automobiles" in the magazine SEI Technical Review, number 82, April 2016, pages 59 to 65, the technical background and the development of tooth geometries of oil pumps of the gerotor type are, for example, explained with the terms Parachoid, Megafloid, Geocloid and Parachoid EX by the manufacturer Sumitomo Electric Sintered Alloy, Ltd. In such gerotors, conventionally trochoid teeth are designed by geometric aids such as epicycles and Nyquist plots. Comparable to a spirograph, tooth-forming cycloids are described as roulettes of a fixed point on the circumference of a pitch circle which rolls along a given curve which relates to a radius of the toothed rotor.

In contrast, laid-open document DE 1002 08 408 A1 proposes a deviation from the conventional development by cycloid curves. To reduce noise, a toothed wheel toothing for toothed ring pumps is described, the tooth tip and tooth root of which are formed by second-order or higher-order curves, wherein the curves point tangentially towards one another at their ends and at least the curves which form the tooth tips or the curves which form the tooth roots are not cycloids. Furthermore, the curves which form the tooth tips are to preferably directly adjoin the curves which form the tooth roots or, in a less preferred manner, can be connected by straight line sections. The second-order curves comprise e.g. a conical section. Illustrations to design the tooth geometry comprise tooth tips and tooth roots which are formed by a circular arc or an elliptical arc.

Furthermore, European patent application EP 2 669 521 A1 discloses a rotor for an oil pump for reducing the noise development. The teeth of the rotor consist in each case of a plurality of ellipses or circles, wherein a tooth half lying in the drive direction and a tooth half lying opposite the drive direction are designed by different ellipses or circles. The latter tooth half should be slightly wider in the circumferential direction of the rotor.

The ellipses disclosed in DE 1002 08 408 A1 and EP 2 669 521 A1 for forming a tooth tip are arranged with their centre on a pitch circle of the corresponding rotor and are arranged radially with respect to the rotor in relation to the minor axis, i.e. the smaller ellipse dimension orthogonal to the principle axis of the larger ellipse dimension.

EP 2 592 271 A2 describes an inner rotor of a toothed wheel pump, the tooth profile of which is composed of three circles to form the tooth profile, said circles being elliptical or circular.

Finally, JP 2011 017318 A describes a tooth profile of an inner rotor of a toothed wheel pump which is composed of curves of different arrangements of ellipses.

Attempts are continuously being made to increase the wear-resistance of the gerotor elements and to reduce the noise development during the course of movement of the gerotor. There is also still room for improvement in relation to said tooth geometries.

Furthermore, in the case of pumps whose design is directed to mobile applications there are likewise attempts to increase the power density, i.e. in particular to increase the volumetric delivery capacity or reduce the size or weight of the pumps in relation to each other.

Accordingly, an object of the invention is to provide, for a gerotor pump, a tooth geometry having optimised frictional contact between the outer teeth and the inner teeth.

Another object of the invention is to provide, for a gerotor pump, a tooth geometry which allows an increase in the effective working volume of the displacement processes between the outer teeth and the inner teeth in relation to a diameter of the gerotor.

The objects are achieved by a toothing for a gerotor pump having the features of claim 1 and by a method for the geometric determination of a toothing for a gerotor pump having the steps of claim 13.

The toothing for a gerotor pump is characterised in particular in that a contour of the outer teeth at the gerotor inner element is defined by a curve of a single ellipse from a tooth tip continuously via tooth flanks to a transition radius towards a tooth space or a tooth root; wherein the principal axis of the ellipse is arranged radially to the gerotor inner element and the centre of the ellipse determines a radius at the gerotor inner element which corresponds to the maximum meshing depth of the gerotor outer element between the outer teeth at the meshing.

The corresponding method for the geometric determination of a toothing for a gerotor pump is characterised in particular by the following steps for determining the contour of the outer teeth of the gerotor inner element: setting one single ellipse, the principal axis of which is arranged radially to the gerotor inner element as well as a regularly dispersed radial arrangement of such ellipses according to a selected plurality of outer teeth; defining contour sections of the outer teeth along a curve of the ellipses; defining contour sections between the outer teeth along a radius that is determined by a centre of the ellipses; wherein the radius at the gerotor inner element corresponds to the maximum meshing depth of the gerotor outer element between the outer teeth at the meshing; and defining transition radii which connect the contour sections of the outer teeth with the contour sections between the outer teeth.

Within this disclosure, the terms used have the following definition.

The principle axis of an ellipse designates the longest dimension between two apexes of the ellipse curves. The minor axis of an ellipse is orthogonal to the major axis and designates the shorter dimension between two apexes of the ellipse curves.

The tooth tip designates a contour section of the toothing on both sides of a centre or apex of the outermost radial extension of the tooth. The tooth flank designates a contour section of the toothing which leads to the tooth tip in the region of the radial extension of the tooth. The tooth root designates a contour section of the toothing on both sides of a centre between two teeth. A tooth space designates a contour section of the toothing between two teeth. A transition radius designates a contour section of the toothing which produces a constant curvature between two differently oriented ends of the curves of adjacent contour sections.

A tip circle designates a circular path along tooth tips of an outer toothing and a circular path along tooth spaces of an inner toothing which produce an outermost meshing depth of the toothing, going beyond the pitch circles or roll circles. A root circle designates a circular path along tooth roots of an outer toothing and a circular path along tooth tips of an inner toothing. A radius $R_{min}$ or minimum radius used in this disclosure designates a radial dimension, up to which a tooth tip or tooth space must be recessed at least in order to ensure complete meshing of a tooth of the other toothing. An eccentricity designates the dimension between the centres of the rotational axes of the two gerotor elements.

The condition that a contour is defined "essentially" by a curve comprises all contours which do not have any appreciable deviation from the given curve. The condition of being "essentially defined" also comprises in particular contours which have deviations of a few hundredths of the extent of the eccentricity to the given curves.

In its most general form, the invention firstly provides a purely elliptical outer tooth geometry, whose radial ellipse extension is greater than an orthogonal ellipse extension in the circumferential direction of the gerotor inner element.

Setting a maximum meshing depth $D_{max}$ of the gerotor outer element, i.e., a radial dimension $R_{min+2*e}$ between the centre of the gerotor inner element and the tip circle of the gerotor outer element when meshing occurs, also specifies that the radial extension of the outer teeth is also greater than a width thereof. Therefore, a more slender and acute tooth contour is produced which has a smaller width in the circumferential direction of the rotor, steeper tooth flanks and a higher curvature at the apex of the tooth tip.

The gerotor toothing in accordance with the invention has many advantages.

Compared with the previously known gerotor toothings, the gerotor toothing in accordance with the invention comes closer to achieving the aim of geometric optimisation that the contact between the gerotor inner element and gerotor outer element is limited to rotational angle ranges which are as small as possible about the bottom dead centre and top dead centre of the eccentric stroke.

The gerotor toothing in accordance with the invention approximately has exclusively purely functional contacts between the gerotor inner element and the gerotor outer element which relate to the drive torque transfer at the bottom dead centre and are used, at the top dead centre, for sealing a delivery cell with respect to leakage flows between the suction side and compression side of the pump chamber, whilst regions between the dead centres which are as wide as possible extend in a contact-free manner. More precisely, when transferring the drive torque at the bottom dead centre force components are produced on oppositely supporting tooth contacts in the region of the top dead centre, which seal a delivery cell more effectively when passing through the top dead centre.

The described ideal course of contact was hitherto not able to be achieved by conventional geometric development methods, or at least could not be influenced in a targeted manner as per the method in accordance with the invention for the geometric determination of the gerotor toothing.

Owing to the local contact limitation and the slender elliptical geometry of the outer teeth, geometrically favourable possibilities for transferring the drive torque are achieved. The elliptical tooth flanks provide very flat contact angles between the outer tooth and inner tooth, whereby the Hertzian stress and the friction torque produced can be considerably reduced at the tooth flanks. There is a minimum change in contact angle between the contacting tooth flanks, whereby the frictional contacts are reduced to a functionally necessary minimum.

Owing to the gerotor toothing in accordance with the invention, positive hydrodynamic effects can be achieved over virtually the entire contact angle range at the bottom dead centre. More precisely, the very flat contact angles produce quasi-stationary hydrostatic pressure effects which separate the two contact surfaces hydraulically. Therefore, a pronounced mixed friction on a linear contact region, as occurs at contact angles of known tooth geometries, can be prevented or at least effectively minimised.

The slender elliptical geometry of the outer teeth additionally permits an increase in the eccentricity between the gerotor inner element and the gerotor outer element, whereby a stroke of the displacement processes and thus the effective working volume between the outer teeth and the inner teeth or the delivery volume per rotation of the gerotor is increased in relation to a diameter thereof.

Advantageous developments and specific details of dimension ratios of the gerotor toothing are described in the dependent claims.

According to one aspect of the invention, a radial extension of the elliptical contour of the outer teeth can have a dimension in the range of the factor 1.0 to 2.0 multiplied by the extent of the eccentricity. This value range of a dimension ratio ensures an elongate elliptical contour section in the region of the tooth flanks up to the beginning of a transition radius, within which a high eccentricity is permitted and optimisation of the above-mentioned advantages is achieved.

According to one aspect of the invention, a dimension of the principal axis of the ellipse can be of the factor 4 multiplied by the extent of the eccentricity. This dimension ensures a long radial extension of the tooth, in the case of which a high eccentricity is met and optimisation of the above-mentioned advantageous is achieved. Said dimension ratio demonstrates in an equivalent manner that the radial dimension of the outer tooth from the tooth tip to the geometrically determined radius to the maximum meshing depth of the gerotor outer element is twice the extent of the eccentricity.

According to one aspect of the invention, the minor axis of the ellipse which is orthogonal to the principal axis can have a dimension of a factor in the range of 0.5 to 2.5, preferably in the range of 1.0 to 2.0, multiplied by the extent of the eccentricity. This value range of a dimension ratio ensures a width of the outer tooth, within which optimisation of the above-mentioned advantages is achieved. By selecting the width of the outer tooth using the minor axis of the ellipse, an overlapping of the contact of a tooth pair in the region of the top dead centre can be influenced in a targeted manner.

According to an aspect of the invention, a contour of the gerotor inner element can be respectively be formed in a concave shape between two outer teeth. Owing to an additional, slightly concave recess of the contour of the tooth space to the radius of the maximum meshing of the gerotor outer element in the region of the tooth root, inner hydraulic work of the displacement processes is reduced because a larger flow cross-section for allowing the displaced medium being conveyed to escape between the gerotor inner element and the gerotor outer element remains to connect tooth pairs upstream of the bottom dead centre. Furthermore, an increased flow cross-section in the tooth space of the gerotor inner element is also used to avoid compression effects during meshing of the toothing at the bottom dead centre. As a result, a pulsation of the initial pressure which is typical for displacement pumps is reduced at the same time, which is directly related to such compression effects.

According to one aspect of the invention, the concave contour at the apex between two outer teeth can have a recess depth to the radius of the maximum engagement of the gerotor outer element of the gerotor inner element, which is a radial dimension of a factor (b) in the range of 0.1 to 0.15 multiplied by the extent of the eccentricity (e). This value range of a dimension ratio ensures a root clearance with respect to the inner toothing of the gerotor outer element 2 for forming a root space in the form of the concave recess of the contour in the region of the tooth root. Within this value range, optimisation of the previously mentioned hydraulic advantages are achieved.

According to one aspect of the invention, a contour of the inner teeth of the gerotor outer element can result from the intersection of an envelope of a family of curves which is set along a course of movement of the gerotor through the contour of the outer teeth of the gerotor inner element. Therefore, a contour of the inner teeth of the gerotor outer element which is adapted to the occurring relative movements within the gerotor is ensured.

According to one aspect of the invention, the gerotor inner element can comprise a number of at least five outer teeth. The number of six inner teeth and five outer teeth forms a threshold teeth number with advantageous proportions of the gerotor which provides an efficient delivery capacity in relation to the dimensions thereof. Furthermore, with this number in the region of the top dead centre there is already at all times contact of two adjacent tooth tips of the gerotor inner element with the gerotor outer element, thereby reliably ensuring the formation of a closed delivery cell for transferring the medium being conveyed from the suction side to the compression side of the pump chamber as a protection against hydraulic short-circuiting.

According to one aspect of the invention, the gerotor outer element can be rotably supported in the gerotor pump and can be rotably dragged along via the meshing by a rotatory drive motion of the gerotor inner element. This pump design does not require any rotating control plate, and so a static inlet and outlet can be provided in the pump chamber as a suction kidney and a compression kidney on the housing-side, and is thus suitable as an advantageous basis for a gerotor pump, by means of which the toothing in accordance with the invention can be achieved.

A gerotor pump having the toothing in accordance with the invention is suitable, owing to the explained advantages of a compact design and power density, in particular for mobile applications such as in automobile construction, in particular the use as an oil pump for a lubricating oil of an internal combustion engine, a transmission oil of an automatic transmission, or a hydraulic oil for driving ancillary units or other actuators to the point of auxiliary devices of utility vehicles.

The invention will be explained in detail hereinafter with the aid of an exemplified embodiment and with reference to the accompanying drawings, in which.

Figure 1:
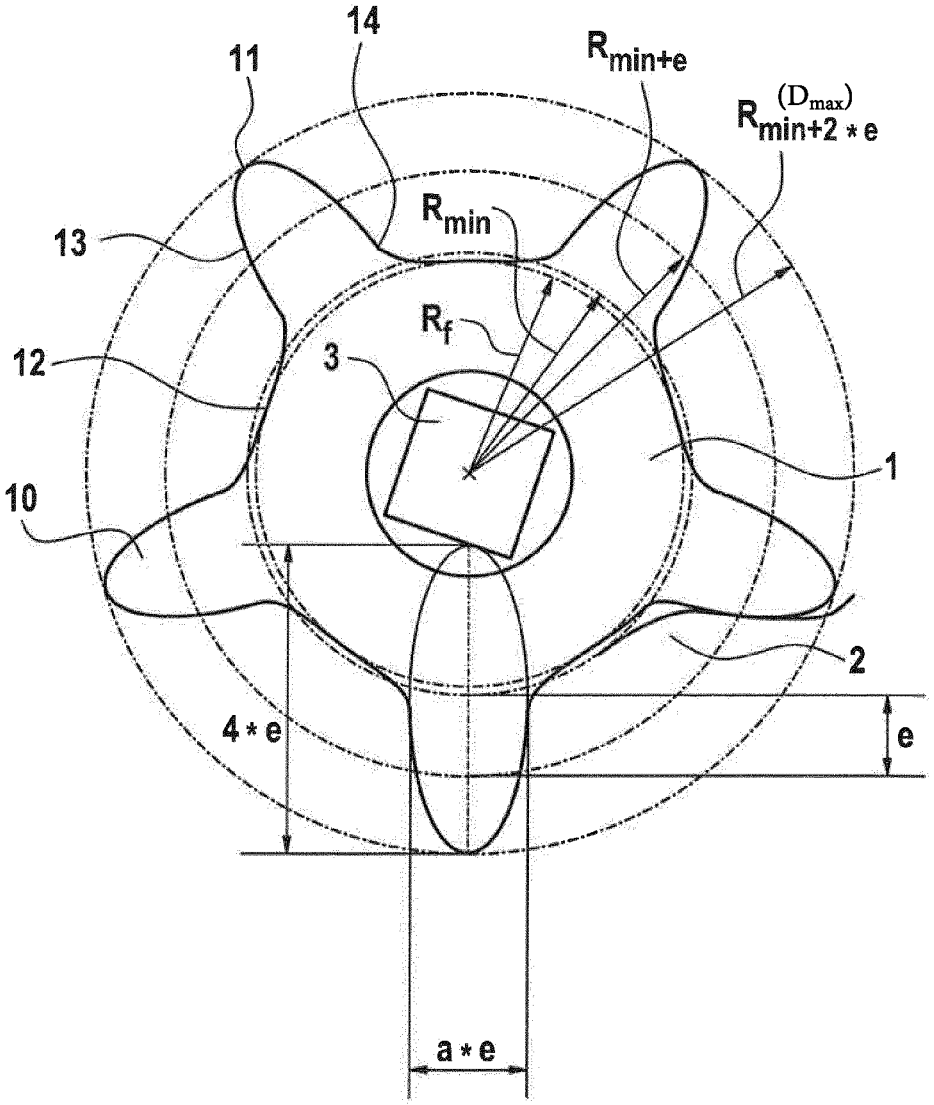
FIG. 1 shows a gerotor inner element with outer teeth of a toothing for gerotor pumps according to one embodiment of the invention, indicating to dimension ratios.

The gerotor comprises a gerotor inner element 1 and a gerotor outer element 2. The gerotor is arranged in a pump chamber of a gerotor pump, not shown. The gerotor inner element 1 is engaged with a rectangular profile of a driven pump shaft 3 and drags along the gerotor outer element 2 via meshing. The gerotor outer element 2 is received in a cylindrical circumferential wall of the pump chamber, not shown, so as to be supported in a sliding manner and to be rotatable via the outer circumference.

When the gerotor rotates to the left, the outer teeth 10 move into and out of the inner teeth 20 as meshing occurs. In a rotational angle section which lies, in the direction of rotation, upstream of the bottom dead centre of the meshing on an axis of the eccentric offset, displacement of a medium being conveyed, in particular an oil, occurs, said medium being drawn in on the other hand in a rotational angle section which lies, in the direction of rotation, downstream of the bottom dead centre. Ejection of the displaced oil and drawing-in occurs in a known manner through an outlet, not shown, and an inlet of the gerotor pump which each issue into the pump chamber on the face-side via a kidney-shaped opening upstream or downstream of the bottom dead centre respectively.

FIG. 1 shows an embodiment of the gerotor inner element 1 with the outer teeth 10 which have an elliptical contour form the tooth tip 11 to beyond the tooth flanks 13, which contour ends only at a transition radius 14 to the tooth roots 12. An ellipse is shown at an outer tooth 10 pointing downwards, the ellipse curve thereof defining the contour of the tooth tip 11 and the tooth flanks 13. In accordance with the provided method for the geometric determination of the gerotor toothing, the essential dimension ratios are given in dependence upon an eccentricity e of the gerotor, i.e. an extent of the offset between a centre $M_1$ of the gerotor inner element 1 and a centre $M_2$ of a gerotor outer element 2.

An ellipse, which is used as an auxiliary curve for the geometric determination of the contour of the outer teeth 10, has a principle axis which is arranged radially to the centre $M_1$ of the gerotor inner element 1. The length of the principle axis is longer than the extent of the eccentricity e by a factor of proportionality. In the illustrated embodiment, this factor of proportionality is preferably set to the value of 4, but it can also deviate therefrom by a few decimal places. The minor axis of the ellipse has a length which is longer than the extent of the eccentricity e by a factor of proportionality a. In the illustrated embodiment, the factor of proportionality a is set to the value of 1.5, but it can also have another value within a range of 0.5 to 2.5, preferably between 1.0 and 2.0. The factor of proportionality a, which defines the length of the minor axis of the ellipse in dependence upon eccentricity, influences the width of the outer teeth 10 in the circumferential direction of the gerotor inner element 1.

The centre of the ellipse, where the principle axis and minor axis intersect, determines a radial extent of the gerotor inner element 1 up to which a tip circle of the inner toothing of the gerotor outer element 2 enters between the outer teeth 10 to a maximum extent as meshing occurs, and thus sets a minimum radius $R_{min}$ up to which a tooth root or tooth space of the outer toothing of the gerotor inner element 1 at least must be recessed. Since the radius $R_{min}$ is set by the centre of the ellipses and the factor of proportionality of the principle axis of the ellipse in the illustrated embodiment has the value of 4, the radial length of an outer tooth 10 corresponds to the factor 2 of the eccentricity, i.e. the radius of a tip circle of the outer tooth is greater than the radius $R_{min}$ by the factor 2 of the eccentricity e and the radius of a pitch circle or roll circle of the gerotor is greater than the radius $R_{min}$ by the extent of the eccentricity e.

Figure 2:
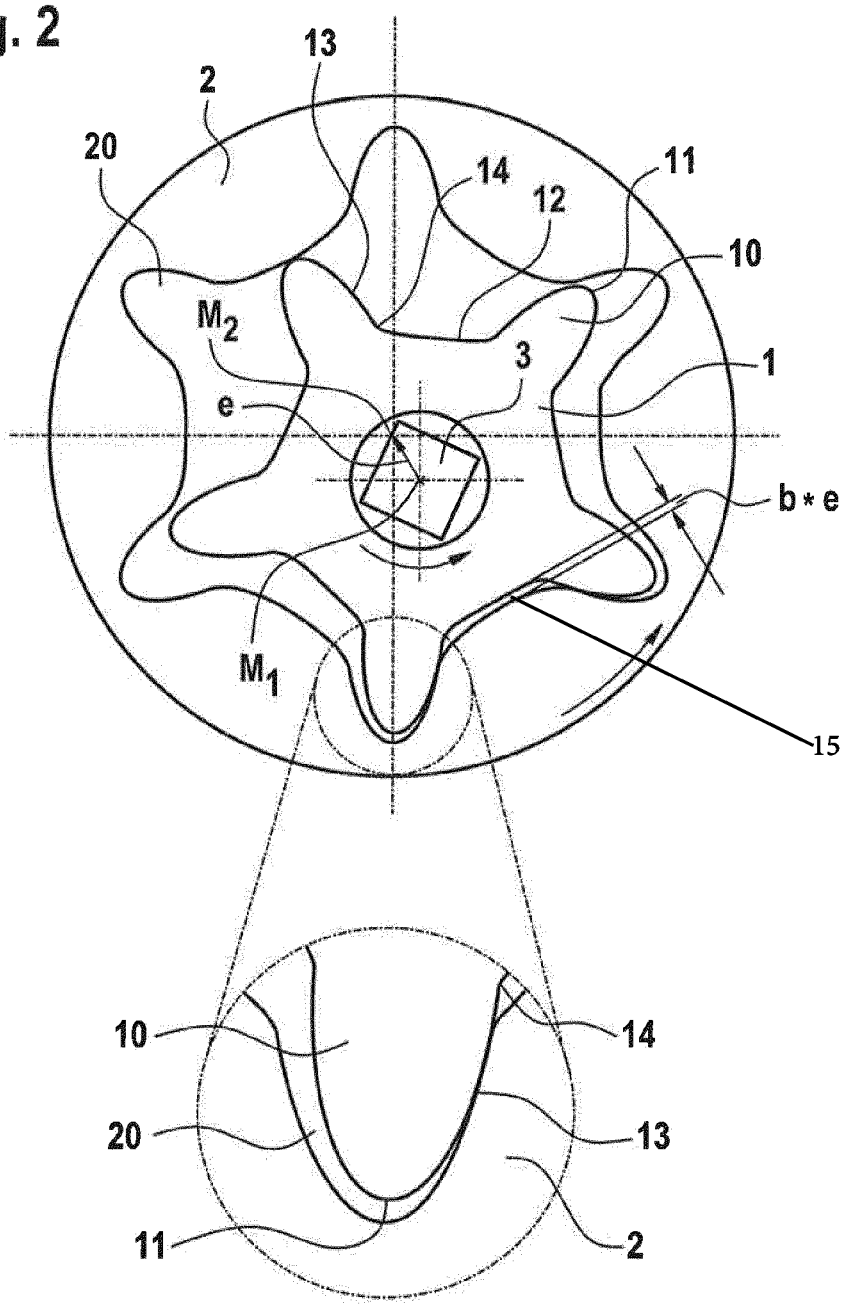
FIG. 2 shows meshing between the gerotor inner element and a gerotor outer element of a toothing for gerotor pumps according to one embodiment of the invention, indicating dimension ratios.

As shown in FIGS. 1 and 2, each tooth space between the outer teeth 10 has a slightly concave recess which is connected to the transition radii 14 to form the tooth flanks 13. An apex of the slightly concave recess is, in the circumferential direction of the gerotor inner element 1, in the centre of each tooth space and at the same time forms the tooth root 12. At the tooth root 12, the contour of the gerotor inner element 1 has, in relation to the radius $R_{min}$, a recess depth, the radial extent of which corresponds to a factor of proportionality b to the eccentricity e. In the illustrated embodiment, the factor of proportionality b has a value of 0.125, but it can also have another value in a preferred range of 0.10 to 0.15.

The radial extent of the recess depth can likewise be referred to as a root clearance 15 which indicates a clearance of distance in the case of maximum meshing between the tooth root 12 of the gerotor inner element 1 and the elevation of the tooth space between the inner teeth 20 of the gerotor outer element 2 at the bottom dead centre of meshing. The root clearance influences the size of a root space having the shape of the concave recess and increases a flow diameter for allowing the oil to escape between the outer teeth 10.

With reference to FIGS. 3A to 3H, the rolling behaviour of a gerotor rotating to the left, i.e. a cyclical relative movement between the gerotor inner element 1 and the gerotor outer element 2, will be described hereinafter. The illustrations show, not necessarily one after the other, different functionally explained rotational angle positions of the gerotor. When the gerotor rotates to the left or anticlockwise, torque is transmitted from the gerotor inner element 1 to the gerotor outer element 2 and the medium being conveyed, or oil, is displaced from the inner teeth 20 through the outer teeth 10.

Figure 3A:
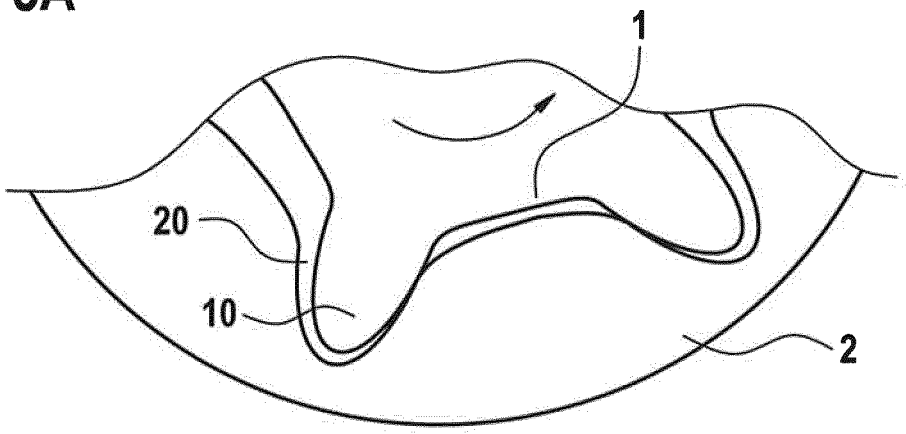
FIGS. 3A-3H show a sequence of a course of movement, rotating to the left, of a toothing for gerotor pumps according to the embodiment of the invention.
Figure 3B:
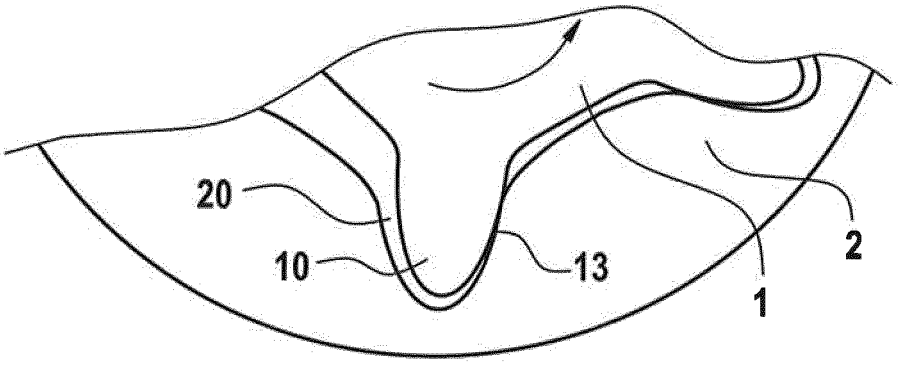
Figure 3C:
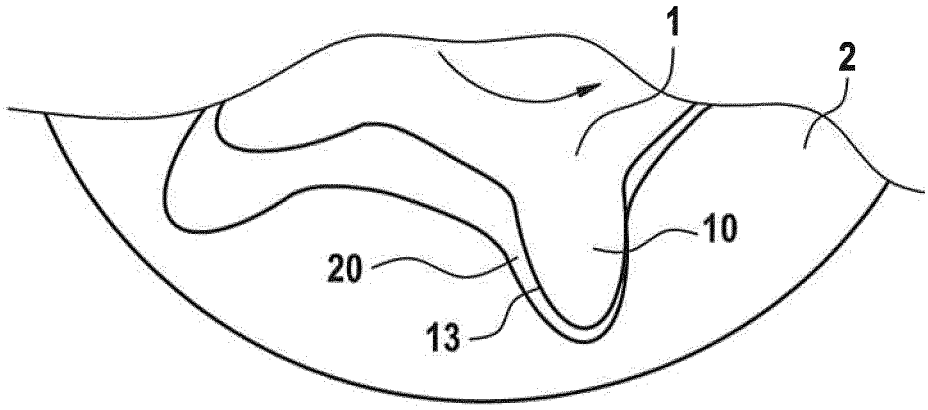
Figure 3D:
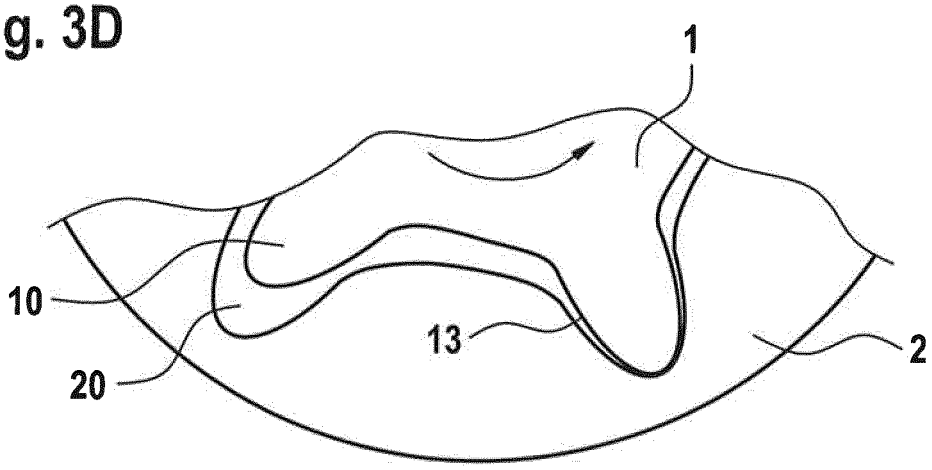
Figure 3E:
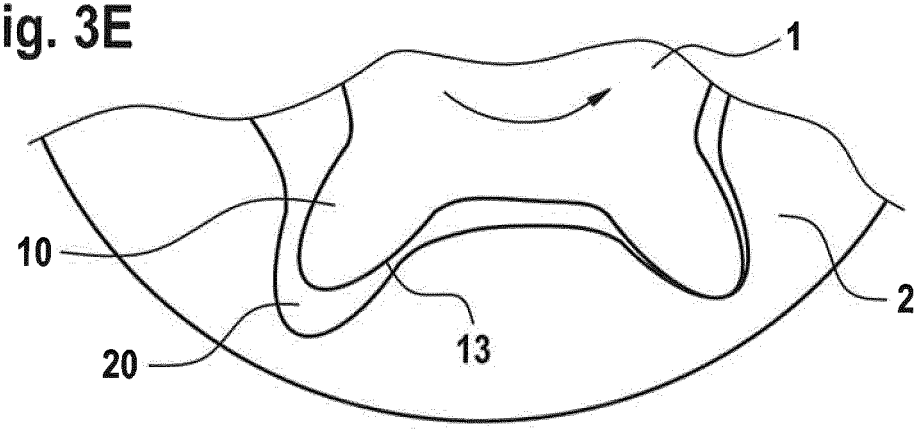

In FIG. 3A, the left outer tooth 10 begins to come into contact with the inner tooth 20 in a very flat contact angle. In FIG. 3B, the outer tooth 10 continues to slide into the inner tooth 20 at a very flat contact angle. Owing to the flat contact angle, a slight Hertzian loading is produced between the tooth flank 13 of the outer tooth 10 and the opposite contour of the inner tooth 20. In FIG. 3C, the right outer tooth 10, which enters the inner tooth 20, effects displacement work, whereby the oil in the inner tooth 20 is urged upwards and to the left through a curved wedge gap along the left tooth flank 13 of the outer tooth 10. In FIG. 3D, the right outer tooth 10 has completely entered the inner tooth 20, whereupon a wedge gap is produced along the tooth flanks 13 on both sides of the outer tooth 10 to the compression side and to the suction side.

Figure 3F:
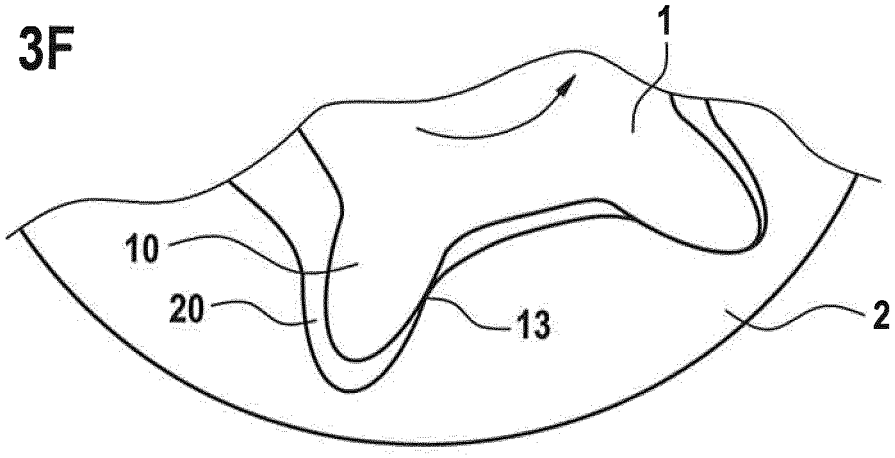

With a rotary movement component, there is superposition of a pivoting movement between the outer tooth 10 and inner tooth 20 about the bottom dead centre of the meshing owing to the eccentricity. The pivoting movement progresses from the right-hand side in FIG. 3C, via a centre position at the bottom dead centre in FIG. 3D, to the left-hand side in FIG. 3E. The wedge gap is further reduced on the side of the left tooth flank 13 of the right outer tooth 10 whilst a following outer tooth 10 moves on the left towards the contact with an inner tooth 20. In FIG. 3F, the right outer tooth 10 begins to slide out of the inner tooth 20 whilst the left outer tooth 10 comes into contact with the following inner tooth 20, in a comparable manner to FIG. 3A, and begins to slide therein, whereby displacement begins again.

Figure 3G:
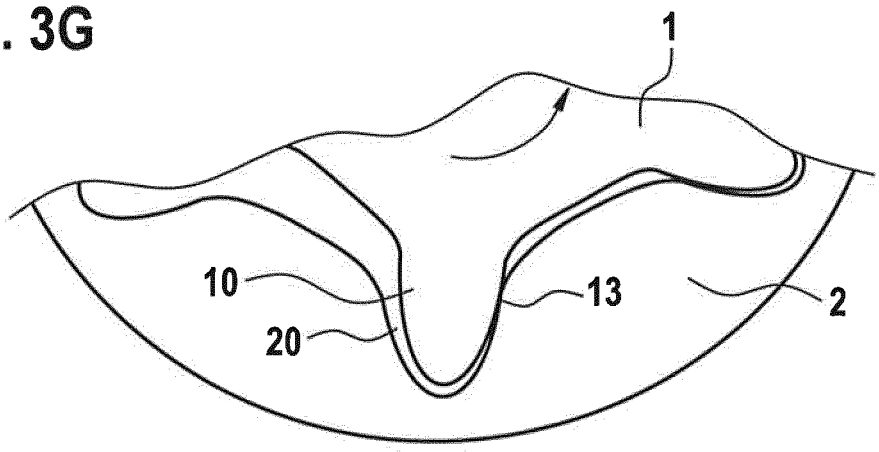
Figure 3H:
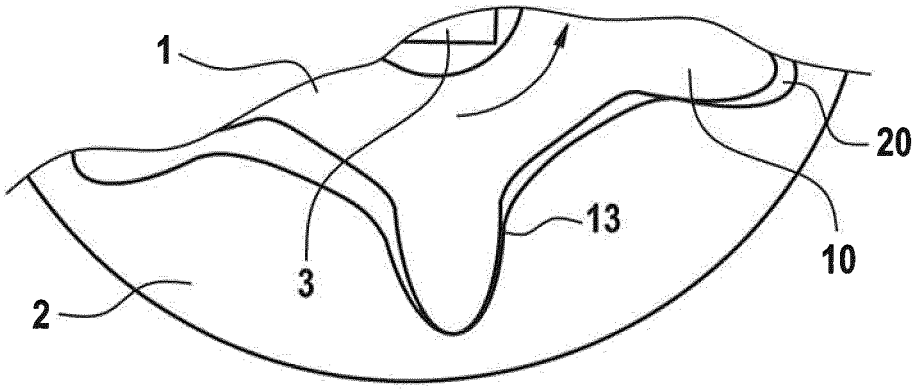

FIG. 3G shows a rotational angle position in which two adjacent outer teeth 10 each transfer torque to the gerotor outer element 2 by their flank contact with the inner teeth 20. FIG. 3H shows once again the very flat contact angle when the outer teeth 10 move into or out of the inner teeth 20, whereby very small Hertzian stresses occur in the region of the contact surfaces of the toothing.

As shown in FIGS. 3A to 3H, the contact surfaces produced along the tooth flanks 13 can be represented by relatively large substitute radii. The relatively large substitute radii produce an increase in the surface contact occurring along the toothing contour compared with conventional tooth geometries. In a manner comparable with a design condition for sliding bearings, the wear on the frictional pair is minimised by the large substitute radii and the flat contact angles.

Hydrostatic effects at the sliding gap of the surface contact can be assumed, not least owing to the additional displacement flows along the contact surfaces which ensure a dynamic lubricating film for wetting the toothing contour. Within the anticipated operating parameters, the hydrostatic effects theoretically prevent direct surface contact on the tooth flanks 13. The theoretical assumption coincides with experimental practice to the extent that according to test series by the inventors, no measurable or visible wear occurred on the gerotor toothing in accordance with the invention.

As an alternative to the illustrated embodiment with the threshold tooth number 5/6 as the ratio of outer teeth 10 of the gerotor inner element 1 to inner teeth 20 of the gerotor outer element 2, the gerotor can likewise be designed with a corresponding tooth number of 6/7, 7/8 or 8/9, wherein the effect of some of the described advantages of the tooth geometry in accordance with the invention is further increased.

LIST OF REFERENCE SIGNS

1 Gerotor inner element
2 Gerotor outer element
3 Pump shaft
10 Outer tooth
11 Tooth tip
12 Tooth root
13 Tooth flank
14 Transition radius
20 Inner tooth
a Factor of proportionality of the ellipses—minor axis
b Factor of proportionality of a root clearance
e Eccentricity
$M_1$ Centre of gerotor inner element
$M_2$ Centre of gerotor outer element
$R_f$ Root circle of the gerotor inner element
$R_{min}$ Radius of the engagement depth of meshing

The invention claimed is:

1. A toothing for a gerotor pump comprising:

a plurality of outer teeth at a gerotor inner element; and a plurality of inner teeth greater by one at a gerotor outer element, wherein a center of the gerotor inner element is offset from a center of the gerotor outer element by an eccentricity such that the outer teeth thereby mesh with the inner teeth, and wherein a contour of the outer teeth at the gerotor inner element is defined by a curve of a single ellipse from a tooth tip continuously via tooth flanks to a transition radius towards a tooth space or a tooth root, and further wherein a principal axis of the ellipse is arranged radially to the gerotor inner element and ellipse determines a radius at the gerotor inner element which corresponds to a maximum meshing depth of the gerotor outer elements between the outer teeth during the meshing, and wherein, in rotation of the gerotor outer element, a root clearance is defined at an apex between two of the outer teeth by the radius of the maximum meshing depth and the eccentricity.

2. The toothing for a gerotor pump according to claim 1, wherein the contour of the outer teeth extends radially and is defined by the eccentricity multiplied by a factor of 4.

3. The toothing for a gerotor pump according to claim 1, wherein the principal axis of the ellipse is defined by the eccentricity multiplied by a factor of 4.

4. The toothing for a gerotor pump according to claim 1, wherein minor axis of the ellipse is orthogonal to the principal axis and is defined by the eccentricity multiplied by a factor between 0.5 to 2.5.

5. The toothing for a gerotor pump according to claim 1, wherein a contour of the gerotor inner element is respectively formed in a concave shape between two outer teeth.

6. The toothing for a gerotor pump according to claim 1, wherein a contour of the gerotor inner element is respectively formed in a concave shape between two outer teeth, and wherein the concave contour includes the root clearance defined by the radius of the maximum engagement of the gerotor outer element, the maximum engagement of the gerotor outer element defined by an extent of the eccentricity multiplied by a factor between 0.1 and 0.15.

7. The toothing for a gerotor pump according to claim 1, wherein a contour of the inner teeth of the gerotor outer element results from an intersection of an envelope of a family of curves which is set along a course of movement of the gerotor pump through the contour of the outer teeth of the gerotor inner element.

8. The toothing for a gerotor pump according to claim 1, wherein the gerotor inner element comprises a number of at least five outer teeth.

9. The toothing for a gerotor pump according to claim 1, wherein the gerotor outer element is rotably supported in the gerotor pump and is rotably dragged along via the meshing by a rotary drive motion of the gerotor inner element.

10. The toothing for gerotor pump according to claim 1, wherein the gerotor pump is adapted to convey lubrication oil to a combustion machine.

11. The toothing for gerotor pump according to claim 1, wherein the gerotor pump is adapted to convey transmission oil.

12. The toothing for gerotor pump according to claim 1, wherein the gerotor pump is adapted to convey hydraulic oil.

13. A method for geometric determination of a toothing for a gerotor pump which comprises a plurality of outer teeth at a gerotor inner element and a plurality of inner teeth greater by one at a gerotor outer element, wherein a center of the gerotor inner element is offset from a center of the gerotor outer element by an eccentricity such that the outer teeth thereby mesh with the inner teeth, the method comprising:

setting one single ellipse, a principal axis of which is arranged radially to the gerotor inner element as well as setting a dispersed radial arrangement of such ellipses according to the plurality of outer teeth;

defining contour sections of the outer teeth along a curve of each ellipse;

defining contour sections between the outer teeth along a radius that is determined by a center of each ellipse, wherein the radius at the gerotor inner element is corresponding to a maximum meshing depth of the gerotor outer element between the outer teeth at the meshing;

defining, in rotation of the gerotor outer element, a root clearance, at an apex between two of the outer teeth, by the radius of the maximum meshing depth and the eccentricity; and defining transition radii which connect the contour sections of the outer teeth with the contour sections between the outer teeth.

14. The method for the geometrical determination of a toothing for a gerotor pump according to claim 13, further comprising:

setting a radial extension of the elliptical contour of the plurality of outer teeth as a function of the eccentricity.

15. The method for the geometrical determination of a toothing for a gerotor pump according to claim 13, further comprising:

setting a dimension of the principal axis of the ellipse as a function of the eccentricity.

16. The method for the geometrical determination of a toothing for a gerotor pump according to claim 13, further comprising:

setting a dimension of an orthogonal minor axis of the ellipse as a function of the eccentricity.

17. The method for the geometrical determination of a toothing for a gerotor pump according to claim 13, further comprising:

defining concave recesses in the contour sections between the outer teeth and determining a recess depth to the radius that is determined by a center of the ellipse as a function of the eccentricity.

18. The method for the geometrical determination of a toothing for a gerotor pump according to claim 13, further comprising:

defining a contour of the inner teeth of the gerotor outer element via an intersection of an ellipse curve which is defined by the contour of the outer teeth of the gerotor inner element.

* * * * *